US006433663B1

(12) United States Patent
Fitzgerald, Jr. et al.

(10) Patent No.: US 6,433,663 B1
(45) Date of Patent: Aug. 13, 2002

(54) HIGH VOLTAGE TRANSFORMER ARRANGEMENT

(75) Inventors: William Vincent Fitzgerald, Jr., Zionsville; Mathew Abraham, Indianapolis; Brian Philip Michael, Greenfield, all of IN (US)

(73) Assignee: Thomson Licensing SA, Boulogne Cedex (FR)

( * ) Notice: Subject to any disclaimer, the term of this patent is extended or adjusted under 35 U.S.C. 154(b) by 0 days.

(21) Appl. No.: 09/471,070

(22) Filed: Dec. 22, 1999

(51) Int. Cl.[7] ..... H01F 17/06
(52) U.S. Cl. ..... 336/178; 336/208; 336/198
(58) Field of Search ..... 336/198, 192, 336/208, 96, 90, 185, 83, 178; 29/605, 606

(56) References Cited

U.S. PATENT DOCUMENTS 4,305,056 A * 12/1981 Mochida et al. ..... 336/178
4,737,755 A 4/1988 Hopmans
4,967,121 A * 10/1990 Nero ..... 315/411
4,980,664 A 12/1990 Harwood
5,285,760 A * 2/1994 Takaishi et al. ..... 336/178

FOREIGN PATENT DOCUMENTS

EP 0629311 12/1994

* cited by examiner

*Primary Examiner*—Anh Mai
(74) *Attorney, Agent, or Firm*—Joseph S. Tripoli; Harvey D. Fried; Joseph J. Kolodka

(57) ABSTRACT

A transformer includes a bobbin with spacers extending inwardly from the bobbin and a barrier extending outwardly from the bobbin. A ferrite core positioned within the bobbin is separated by the spacers to provide a controlled air gap. Primary windings wound around the bobbin are separated into series connected windings by the barrier. The barrier is aligned with spacers so as to prevent any wound portion of the primary windings from overlapping the air gap in the ferrite core.

23 Claims, 3 Drawing Sheets

HIGH VOLTAGE TRANSFORMER ARRANGEMENT

BACKGROUND

This invention relates to high voltage transformers.

A high voltage transformer (HVT), also referred to as a flyback transformer, is employed in television receivers to boost the B+voltage from the power supply to 20–30 kV applied to the cathode ray tube (CRT), as well as provide various secondary lower voltages for other circuits. The flyback transformer is driven by a pulse waveform of relatively high voltage, typically, between 1200 volts and 1400 volts.

The operating life of a winding in a flyback transformer can be increased by reducing voltage stress impressed on the flyback transformer when a high voltage is applied. Moreover, subjecting the winding to high voltages at higher frequencies increases adverse voltage stress effects on the windings.

A method for reducing voltage stress on a winding of a transformer divides the winding into multiple windings. For a primary winding, a full voltage is applied over multiple windings electrically coupled in series. Voltage impressed upon each of the individual windings is less than the sum total voltage impressed over all the windings. Similarly, for secondary windings the output voltage is developed over multiple windings so that voltage developed by an individual winding is less than the sum total voltage developed by all the secondary windings, which is the output voltage of the transformer.

A further consideration in the operation of a flyback transformer is losses in the inductive coupling between the primary and secondary windings. Magnetic losses occur when part of the primary winding overlaps an air gap in a ferrite core surrounded by the primary winding. That part of the winding overlapping with the air gap is not inductively coupled to the secondary winding, thereby reducing the amount of voltage at the primary side that can be stepped up to an output voltage level at the secondary side. The air gap in the ferrite core is critical to proper operation of the flyback transformer. The gap thickness in the ferrite core can be controlled by insertion of a plastic spacer between segments or ends of the ferrite core where an air gap is desired. Other transformer designs incorporate a core gap spacer integral with the primary bobbin.

Individually, the use of a core gap spacer or series coupled windings will not substantially increase the operating life of the winding and flyback transformer to a duration consistent with the life expectancy of equipment applications for the flyback transformer. Accordingly, there is a need for a high voltage transformer that satisfactorily reduces voltage related stress and magnetic losses on the transformer winding.

SUMMARY

In accordance with an inventive arrangement there is provided a bobbin for primary windings in a high voltage transformer. The bobbin includes a sleeve; a barrier extending outwardly from the sleeve for spatially separating primary windings of a transformer wound around the sleeve that are electrically coupled to each other; and a spacer aligned with the barrier, extending inwardly from the sleeve and substantially defining an air gap for a ferrite core adapted to be mounted within the sleeve, the air gap being thereby substantially aligned with the barrier.

In accordance with a different inventive arrangement there is provided a transformer including a primary bobbin having a barrier extending outwardly therefrom and a spacer extending inwardly therefrom, the spacer being substantially aligned with the barrier; ferrite core segments each having first and second limbs, each of the first limbs having ends secured to each other, each of the second limbs adapted to be mounted within the primary bobbin and separated from each other by the spacer substantially defining an air gap between the second limbs, the air gap thereby being substantially aligned with the barrier; at least two primary windings coupled to each other, wound around the primary bobbin and separated by the barrier; a secondary bobbin around the primary windings and the primary bobbin; and a secondary winding wound around the secondary bobbin.

In accordance with a further different inventive arrangement there is provided a transformer including a primary bobbin with a radially and outwardly extended barrier, a ferrite core positioned within the primary bobbin, the ferrite core having an air gap and adapted to be mounted within the primary bobbin with the air gap substantially aligned with the barrier; at least two primary windings around the primary bobbin that are separated by the barrier and electrically coupled to each other; a secondary bobbin, and a secondary winding wound around the secondary bobbin and inductively coupled to the primary windings.

DRAWINGS

DESCRIPTION OF THE PREFERRED EMBODIMENT

Figure 1:
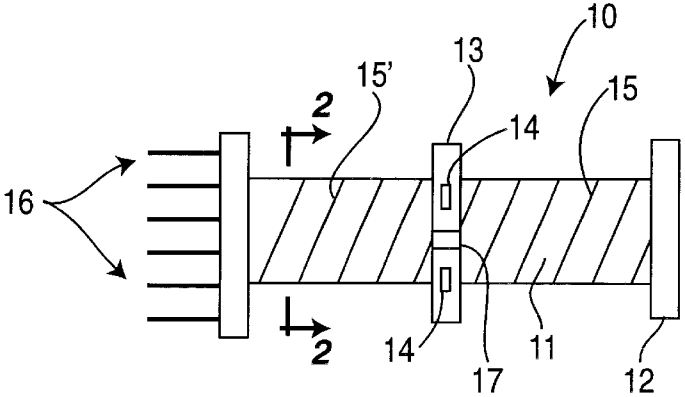
FIG. 1 is a side view of a primary bobbin for a flyback transformer.
Figure 2:
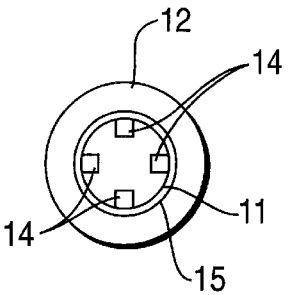
FIG. 2 is a cross-section view of the primary bobbin of FIG. 1.

The primary bobbin 10 of FIG. 1 includes a sleeve 11 with end flanges 12, winding barrier 13, and core gap spacers 14. Winding barrier 13 and core gap spacers 14 can be integral features of sleeve 11. Alternatively, core gap spacers 14 can be distinct components secured to sleeve 11 in a known manner. Winding barrier 13 extends radially and outwardly from sleeve 11 and includes a crossover groove or indentation 17 through which a length of the conductor between primary windings 15 and 15' is guided. Core gap spacers 14 extend radially and inwardly from sleeve 11, as shown in the end view of FIG. 2.

Figure 4:
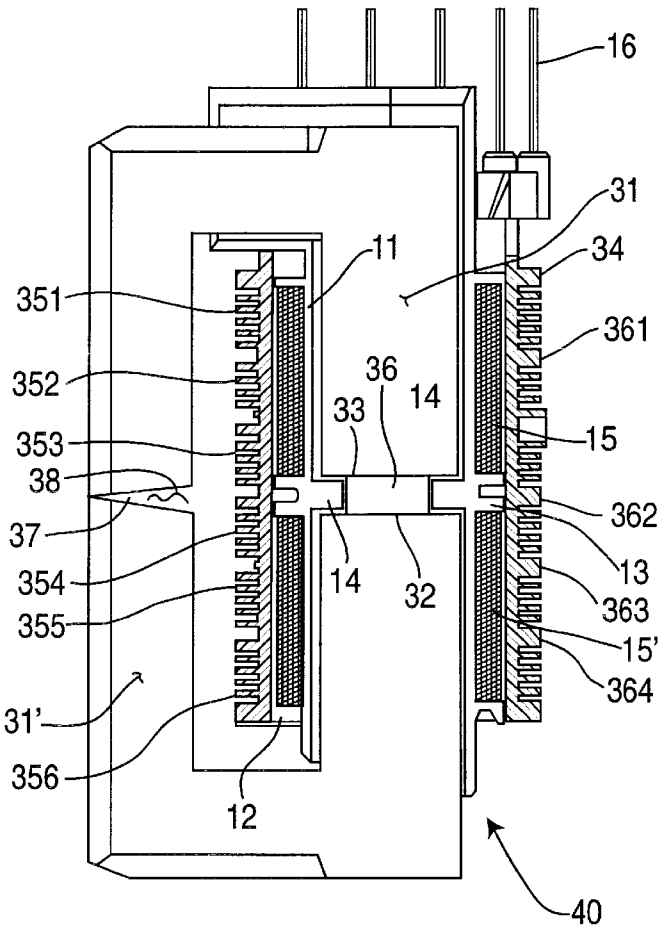
FIG. 4 is a partial-section view of a flyback transformer employing the primary bobbin of FIGS. 1 or 2.

An exemplary transformer assembly 40 is shown in FIG. 4. Connection to the transformer 40 by external circuitry is made via pin connector 16. Ferrite core segments 31 and 31' are joined together with legs or limbs located inside sleeve 11. End surfaces 32, 33 of ferrite core segments 31, 31' are positioned or located inside sleeve 11, and separated by air gap 36 having a thickness substantially defined by the width of gap spacers 14. Core segments outside sleeve 11 abut to form air gap 37, in which wire 38 is disposed. Resilience or elasticity of wire 38 can permit air gap 37 to be changed, thereby adjusting inductance of primary windings 15, 15'. Wire 38 can be in the form of a single wire, coiled wire or twisted wire pair, in which wire 38 is resilient or elastic to accommodate adjustment of air gap 37. Gap spacing structures are detailed in U.S. Pat. No. 4,591,819.

During construction and calibration of transformer assembly 40, air gap 36 between ends 32,33 of the ferrite segments 31, 31' can be set by either engaging ends 32,33 with spacer 14 so that the ends 32,33 are closely positioned near spacer 14, as shown in FIG. 4, or engaging ends 32,33 so that spacer 14 is slightly compressed by ends 32,33. In either case, transformer assembly 40 can be constructed and calibrated with ends 32,33 closely spaced from or compressing spacer 14, while spacer 14 substantially defines the width of air gap 36 and sets air gap 36 in substantial alignment with barrier 13.

Positioning of core segments 31, 31' with respect to sleeve 11 can be achieved by known fasteners or adhesives. Ends of core segments 31, 31' outside sleeve 11 can be secured together by a clamp that is flexible to accommodate relative movement of core segments 31,31' for adjusting air gap 37.

Primary windings 15, 15' are separated by integral barrier 13 and electrically coupled in series. Barrier 13 includes a crossover groove or indentation 17 that accommodates the interconnecting conductor between primary windings 15, 15'. Primary sleeve 11 and windings 15, 15' are surrounded by a secondary bobbin 34, around which a secondary winding is wound.

Primary bobbin 10 reduces voltage stress to the input winding of the flyback transformer 40 by separating the primary winding into multiple windings 15 and 15' with barrier 13. The barrier 13 can be a plastics material molded into the transverse of sleeve 11 so as to permit two separate windings 15, 15' to be wound on sleeve 11. Windings 15, 15' are connected in series so that only a portion of the total voltage is impressed across each winding 15, 15'. In the embodiment of FIG. 1, half of the total voltage applied to the primary windings 15, 15' would be impressed across each of the windings.

Although the exact width of barrier 13 is not critical, the width can be advantageously employed to reduce magnetic losses by aligning barrier 13 with air gap 36 between the legs or limbs of ferrite core segments 31, 31'. The width of barrier 13 can be set to prevent any part of windings 15,15' from substantially overlapping with air gap 36. Any part of air gap 36 under a part of primary windings 15,15' would prevent inducement of a magnetic field in that part of primary windings 15, 15', which would otherwise contribute to inducement of a higher voltage in a secondary winding. As another advantageous feature, barrier 13 is aligned directly over air gap 36, as shown in FIG. 4. A width of the barrier 13 can be dimensioned to maintain each turn of windings 15, 15' at least 2 diameters of a wire in the turns of windings 15 or 15' from air gap 36, measured axially with respect to sleeve 11.

Figure 3:
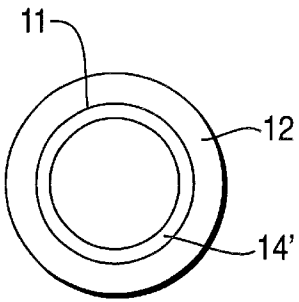
FIG. 3 is a cross-section view of an alternative primary bobbin.

Advantageously, to minimize the width of barrier 13 air gap 36 can be aligned directly with barrier 13. Positioning air gap 36 at this location with respect to barrier 13 is assured by core gap spacers 14. Core gap spacers 14 are dimensioned to attain a desired air gap thickness and position air gap 36 with respect to barrier 13. Core gap spacers 14 can be a plastics material molded on the interior of sleeve 11, also made of a plastics material. Alternatively, core gap spacers 14 can be a single and continuous spacer 14', as shown in FIG. 3, reduced in depth so as to permit an air gap between the legs or limbs of core segments 31, 31'.

Figure 5:
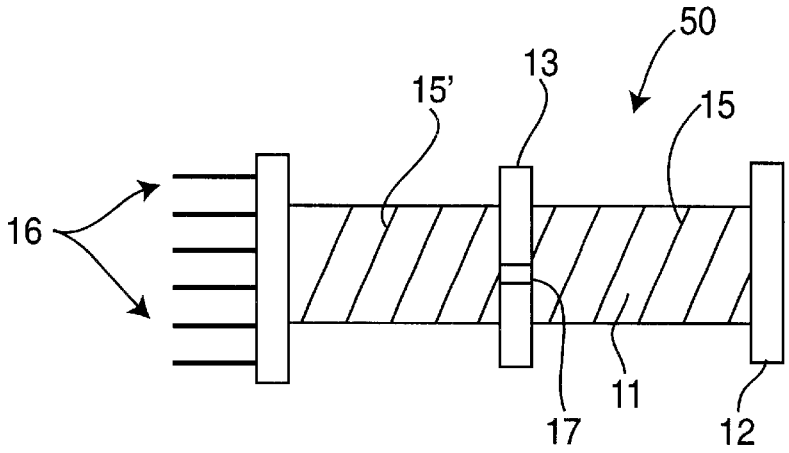
FIG. 5 is a side view of an alternative primary bobbin.
Figure 6:
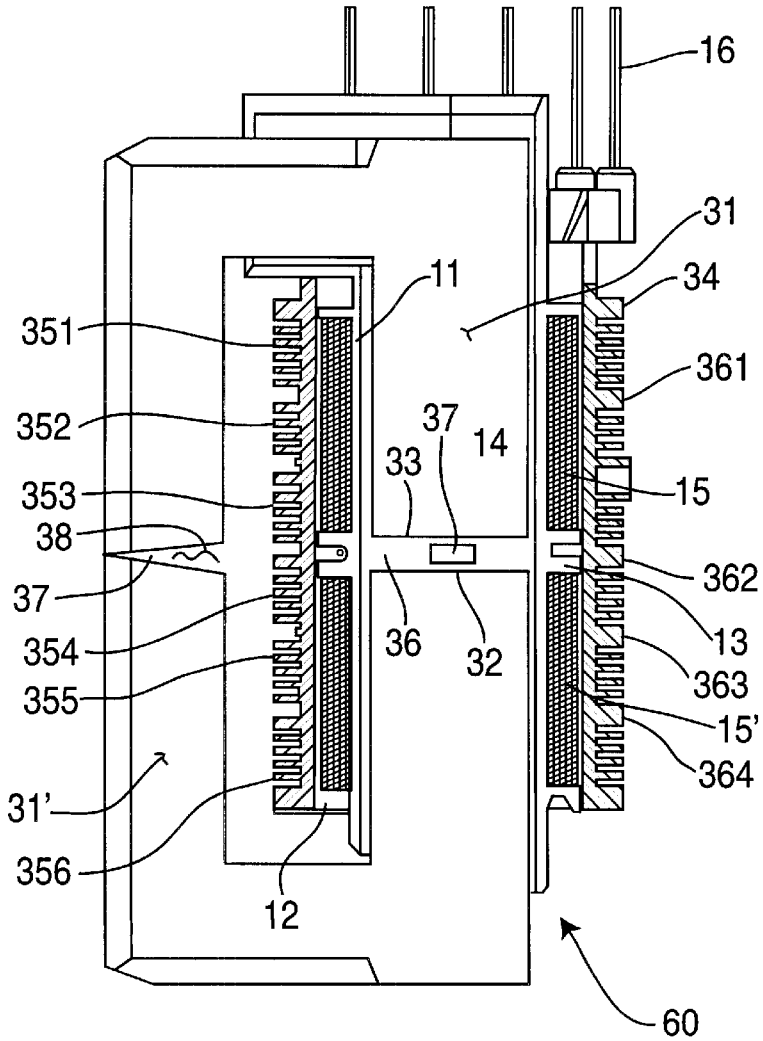
FIG. 6 is a partial-section view of an alternative transformer employing the primary bobbin of FIG. 5.

An alternative primary bobbin 50 without core gap spacers, according to FIG. 5, is advantageously employed in transformer 60 according to FIG. 6. Substantial alignment between air gap 36 and barrier 13 can be set by positioning bobbin 50 relative to core segments 31, 31'. Air gaps 36 and 37 can be adjusted to achieve desired inductance in primary windings 15, 15', and thereafter, core segments 31, 31' can be secured to bobbin 50 by known adhesive or fastener methods. An optional gap spacer 37 can be inserted between core segments 31, 32 to set air gap 36 to a desired thickness.

Figure 7:
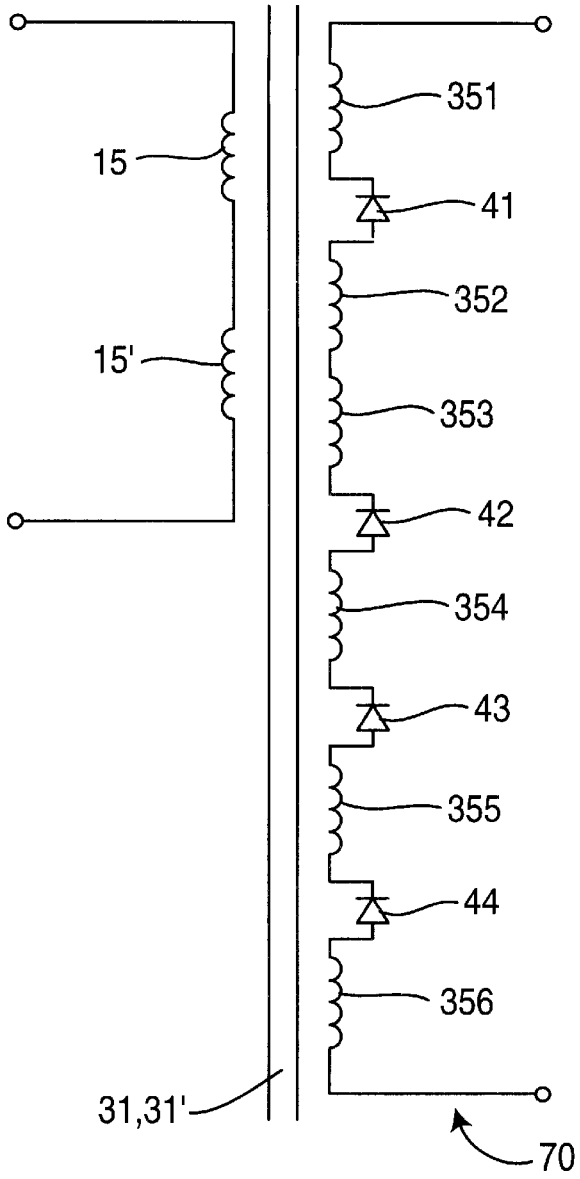
FIG. 7 is a circuit arrangement for the transformer according to FIGS. 4 or 6.

Advantages with primary bobbins 10 or 50 can be realized by transformers employing various secondary winding configurations. In an exemplary inventive transformer, according to circuit schematic 70 of FIG. 7, secondary windings of the flyback transformer include multiple windings 351–356 coupled in series through rectifying diodes 41–44. The secondary windings 351, 352–353, 354, 355 and 356, depicted in FIG. 4, are wound on multiple slots of secondary bobbin 34. Application of diodes 41–44 for rectifying voltages developed across the secondary windings and compensating for capacitance in the windings is known. The rectifying diodes 41–44 are positioned on corresponding posts 361–364 in which terminals of the diodes are inserted to hold them. As with primary windings 15, 15', use of multiple secondary windings permits development of an output voltage in the order of 20 to 30 kV, while reducing the voltage developed across each individual secondary winding to less than that of the output voltage of 20 to 30 kV.

Figure 8:
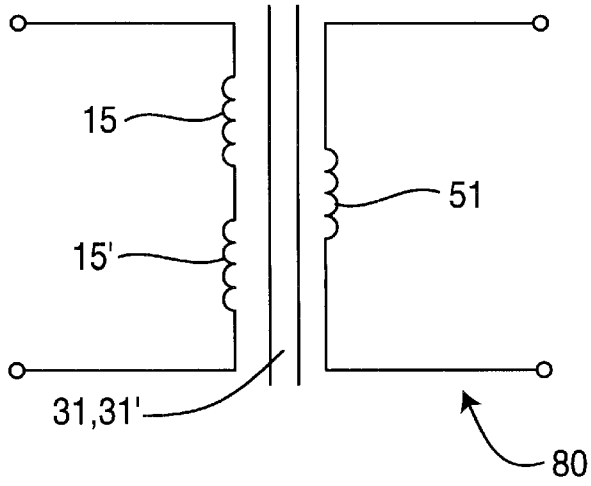
FIG. 8 is an alternative circuit arrangement for the transformer according to FIGS. 4 or 6.

Various beneficial results can also be realized in an inventive transformer with a single secondary winding 51 according to circuit schematic 80 of FIG. 8. Reduction of voltage stress and magnetic losses can also be achieved in this embodiment.

Primary bobbin 10 with integral barrier 15 and core gap spacers 14 or spacer 14' assures precise control and alignment of windings 15 and 15' and air gap 36 thickness so as to reduce voltage stress on primary windings 15, 15', while minimizing winding or magnetic losses that would result if any part of windings 15 or 15' were over the air gap 36. An inventive arrangement of winding barrier 13 and core gap spacer 14 or 14' facilitates assembly of the flyback transformer without need for costlier manual alignment between the air gap 36 and barrier 13 separating primary windings 15 and 15'. Transformer assembly 40 affords sufficient precision n aligning air gap 36 with a separation of primary windings 15, 15' to consistently achieve desired reduction of both voltage stress on the primary windings and magnetic losses which would occur if the primary windings overlapped air gap 36.

What is claimed is:

1. A bobbin for primary windings in a high voltage transformer, said bobbin comprising:

a sleeve;

a barrier extending outwardly from said sleeve for spatially separating primary windings of a transformer wound around said sleeve that are electrically coupled to each other; and a spacer aligned with said barrier, extending inwardly from said sleeve and substantially defining an air gap for a ferrite core adapted to be mounted within said sleeve, said air gap being thereby substantially aligned with said barrier.

2. The bobbin according to claim 1, wherein said barrier is aligned over said spacer, and the width of said barrier exceeds the width of said spacer.

3. The bobbin according to claim 1, wherein the width of said barrier maintains said windings at least two diameters of wire in said windings away from said spacer as measured axially with respect to said sleeve.

4. The bobbin according to claim 1, where said barrier and said spacer are integral with said sleeve.

5. The bobbin according to claim 1, wherein said spacer comprises multiple spacers with a width defining said air gap.

6. The bobbin according to claim 1, wherein said barrier comprises a passage through which said windings are coupled.

7. A transformer comprising:

a primary bobbin having a barrier extending outwardly therefrom and a spacer extending inwardly therefrom, said spacer being substantially aligned with said barrier;

ferrite core segments each having first and second limbs, each of said first limbs having ends secured to each other, each of said second limbs adapted to be mounted within said primary bobbin and separated from each other by said spacer substantially defining an air gap between said second limbs, said air gap thereby being substantially aligned with said barrier;

at least two primary windings coupled to each other, wound around said primary bobbin and separated by said barrier;

a secondary bobbin around said primary windings and said primary bobbin; and a secondary winding wound around said secondary bobbin.

8. The transformer of claim 7, wherein said barrier is wider than and aligned over said spacer.

9. The transformer of claim 7, wherein said barrier is dimensioned to maintain said winding segments at least two diameters of wound wire in said primary windings away from said air gap measured axially with respect to said primary bobbin.

10. The transformer of claim 7, wherein said barrier and spacer are integral with said primary bobbin.

11. The transformer of claim 10, wherein said primary bobbin, barrier and spacer are of a plastics material.

12. The transformer of claim 7, wherein said spacer comprises a plurality of spacers for maintaining an air gap between ends of said second limbs of said ferrite core segments.

13. The transformer of claim 7, wherein said barrier comprises a pathway over which said primary windings are electrically coupled in series.

14. The transformer of claim 7, wherein said secondary winding comprises multiple secondary windings electrically coupled in series across rectifying diodes.

15. The transformer of claim 7, wherein said first limbs of said ferrite core segments are separated from each other at their ends by a second air gap for adjusting inductance of said primary windings.

16. The transformer of claim 15, further comprising a wire disposed in said second air gap between said ends of said first limbs.

17. A transformer comprising:

a primary bobbin with radially and outwardly extended barrier, a ferrite core having an air gap and being adapted to be mounted within said primary bobbin with said air gap substantially aligned with said barrier;

at least two primary windings around said primary bobbin that are separated by said barrier and electrically coupled to each other; and a secondary bobbin around which a secondary winding is wound and inductively coupled to said primary windings.

18. The transformer of claim 17, wherein said barrier is wider than said air gap as measured along an axis of said primary bobbin.

19. The transformer of claim 17, wherein said barrier comprises a crossover indentation over which said primary windings are coupled.

20. The transformer of claim 17, wherein said barrier and said air gap are dimensioned and aligned to maintain said primary windings at least two wire diameters from said air gap as measured along an axial length of said primary bobbin.

21. The transformer of claim 17, wherein said primary bobbin and barrier are an integral plastics member.

22. The transformer of claim 17, wherein said ferrite core comprises a second air gap outside said primary bobbin, inductance of said primary windings changing in response to a change in thickness of said second air gap.

23. The transformer of claim 17, further comprising a wire disposed in said second air gap.

* * * * *